US006024265A

United States Patent [19]

Clements

[11] Patent Number: 6,024,265

[45] Date of Patent: Feb. 15, 2000

[54] RUCKSACK

[75] Inventor: James Clements, Boulder, Colo.

[73] Assignee: Lowe Alpine Holdings Limited, Cumbria, United Kingdom

[21] Appl. No.: 09/180,537

[22] PCT Filed: May 6, 1997

[86] PCT No.: PCT/GB97/01218

§ 371 Date: Dec. 14, 1998

§ 102(e) Date: Dec. 14, 1998

[87] PCT Pub. No.: WO97/42851

PCT Pub. Date: Nov. 20, 1997

[30] Foreign Application Priority Data

May 10, 1996 [IE] Ireland ..... S960339

[51] Int. Cl.[7] ..... A45F 3/04

[52] U.S. Cl. ..... 224/630; 224/259; 224/627; 224/631; 224/645

[58] Field of Search ..... 224/630, 627, 224/628, 631, 637, 641, 650, 645, 648, 660, 250, 257, 259, 262

[56] References Cited

U.S. PATENT DOCUMENTS

| | | | |
|---|---|---|---|
| 4,096,978 | 6/1978 | Noice . | |
| 5,090,604 | 2/1992 | Howe . | |
| 5,529,230 | 6/1996 | Smith | 224/625 |
| 5,586,705 | 12/1996 | Leonard | 224/631 |
| 5,725,139 | 3/1998 | Smith | 224/637 |
| 5,890,640 | 4/1999 | Thompson | 224/630 |

FOREIGN PATENT DOCUMENTS

| | | |
|---|---|---|
| 750508 | 8/1933 | France . |
| 1032292 | 6/1953 | France . |
| 834728 | 3/1952 | Germany . |

OTHER PUBLICATIONS

"Osprey Packs. 1995" Catalogue, pp. 1–25.

*Primary Examiner*—Stephen P. Garbe
*Assistant Examiner*—Maerena W. Brevard
*Attorney, Agent, or Firm*—Young & Thompson

[57] ABSTRACT

A rucksack comprises a sack (1), a carrying harness (11) and a waistbelt (12). The rucksack has an external frame member comprising a U-shaped hoop (20) which is connected by its free ends to the waistbelt (12) and extends around the side walls (4) and front wall (2) of the rucksack (1). Compression straps (25, 28) are connected between the hoop (20) and the rucksack such that the hoop (20) may be adjusted relative to the rucksack (1). The hoop (20) is held in a sleeve (21) sewn to the walls (2, 4) of the rucksack (1).

11 Claims, 5 Drawing Sheets

RUCKSACK

FIELD OF THE INVENTION

The invention concerns a rucksack. The invention is particularly concerned with a rucksack having a device which acts to transfer load within the rucksack carrying system, and for compressing the load within the rucksack.

The term "rucksack" as used comprises a load-carrying bag having a front and a back wall and two side walls. A carrying harness is attached to the back wall of the rucksack. Typically the shoulder harness comprises a pair of shoulder straps which are attached at their upper ends to the back wall of the rucksack with means for attaching the shoulder straps to the back wall of the rucksack and are adjustable as described, for example in PCT WO94/261434.

The lower ends of the shoulder straps are attached to the lower corners of the back wall of the rucksack by adjustable straps. Typically, the rucksack is provided with a waistbelt which is also attached to the back wall of the rucksack at a lower part thereof. The waistbelt is intended to fit around the waist of the person carrying the rucksack ("the user") and is intended to rest on the hips of the user.

In an earlier rucksack design, the load carrying bag simply hung from the shoulders of the user, and the greater part of the load was distributed onto the shoulders of the user. This causes excessive tiredness and fatigue in the shoulder muscles and it is difficult to carry heavy loads for long periods. It is known that it is desirable to transfer the load from the shoulders to the lumbar region of the spine and unto the hips. It is also desirable to stabilise the load within the rucksack and reduce swaying of the load. Finally, the centre of gravity of the load should be brought close to that of the user for improved stability.

During the 1970's some of these objects were partly achieved by providing an internal frame in the back wall of the rucksack. The frame comprises a pair of aluminium bars or staves which extended vertically to each side of the back wall of the rucksack. The frame staves are contained within fabric sleeves formed in the back wall of the rucksack.

The staves act to transfer a proportion of the pack load from the shoulders to the hips of the users, while simultaneously flexing to absorb jolts.

In the prior art, side compression of the load is achieved by means of load compression straps attached to the side walls of the rucksacks which can be tightened to bring the front and back walls of the rucksack together to partly compress the load within the rucksack.

However, with this arrangement, the loaded rucksack is free to sway from side to side as it is carried by the user. This can be disconcerting and dangerous to the user when climbing on steep ground or when the pack is used for high-energy activity such as mountain running.

It is also known to have an internal frame in the back wall of a rucksack. The internal frame comprises a sheet of plastics or the like incorporated within the back wall of the rucksack, and extending substantially vertically of the rucksack. The plastic sheet may be stiffened by means of a metal (for example, aluminium) bar extending upwardly and centrally of the back wall of the rucksack. A pair of glassfibre rods is provided to each side of the plastics sheet and extend vertically of the back wall of the rucksack, and are contained within vertical sleeves formed, to each side of the back wall, at the corner portion between the back wall and the side walls of the rucksack. The glass fibre rods service to assist in transferring load from the top to the waist belt of the rucksack. However, they are not effective in transferring load from the front portion of the rucksack, nor do they act to adequately compress the load. Furthermore, they do not prevent swaying of the rucksack during use. In addition, this system is heavy to carry, and is expensive to manufacture.

In a further modification of the aforesaid system, the two parallel rods are replaced by a single rod which is bent into an inverted u-shape, and is attached in a planar fashion, vertically to the back wall of the rucksack. Again, this assists in transferring load from the back portion of the pack to the hip belt, but does not act to transfer load from the front of the rucksack, nor does it prevent swaying, or provide for compression of load.

DE-C- 834 728 discloses a rucksack having stiffeners inside the front and rear walls of the sack. Tightening straps are provided to draw the stiffeners nearer to each other.

Thus, with conventional rucksacks there is no external frame system which acts to transfer load from the front portion of the rucksack to the hip belt. When conventional rucksacks are partially or near empty there is a tendency towards loss of control of the load because the rucksack tends to collapse on itself, and the load hangs uncomfortably at the bottom of the rucksack.

OBJECT OF THE INVENTION

It is an object of the invention to seek to alleviate the above disadvantages and to provide an improved frame system for a rucksack which aids in transferring load from the front of the rucksack, to the hip belt attached to the lower portion of a back wall of the rucksack, and which also aids in compressing and controlling the load within the rucksack, even when partially empty. It is also an object of the invention to provide a frame system for a rucksack which will reduce swaying of the rucksack horizontally, from side to side, as it is carried. It is also an object of the invention to control load movement within the sack in the vertical plane by reducing sagging and bouncing of the front of the pack during use.

SUMMARY OF THE INVENTION

The invention concerns a rucksack comprising a sack having a front wall, a back wall, and two side walls, and a carrying harness including a waistbelt wherein the rucksack includes a frame having a semi-rigid hoop which extends around the side walls and the front of the sack, characterised in that the hoop is retained in a sleeve or sleeves or loops formed in or attached to the side walls and front wall of the sack and the hoop extends from the lower back corner on each side of the sack, at or adjacent the waistbelt, across the front of the rucksack and wherein the ends of the hoop are connected, one at each side of the rucksack, to the waistbelt by adjustable strap means. Straps are attached to the sleeve at intervals, to enable the hoop to be compressed relative to the rucksack so as to press against a load contained within the rucksack, and to control movement of the load.

BRIEF DESCRIPTION OF THE DRAWINGS

The invention will now be described more particularly with reference to the accompanying drawings which show, by way of example only, one embodiment of a rucksack according to the invention. In the drawings.

MODES FOR CARRYING OUT THE INVENTION

Figure 1:
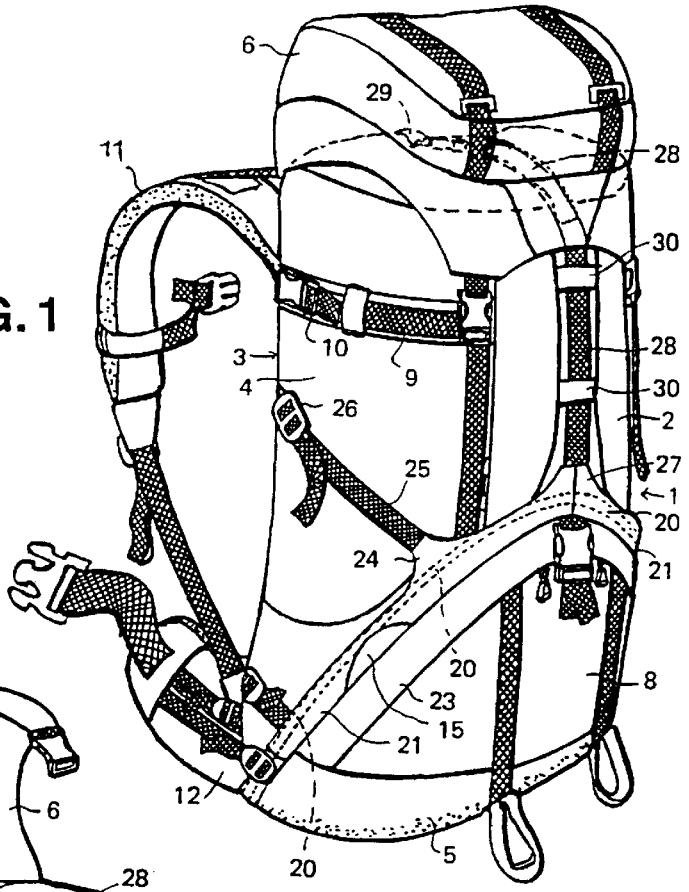
FIG. 1 is a front view of a rucksack of the invention.

Referring to the drawings, a rucksack comprises a sack 1 made from a suitable fabric. The sack 1 comprises a front panel (or wall) 2, a back panel (or wall) 3, and two side panels (or walls) 4. Suitably the side panels 4 are sewn along their edges to the edges of the front and back panels 2, 3 respectively to form the sack. A bottom panel 5 forms the bottom of the sack.

The sack 1 is provided with a cover or lid 6. The lid 6 is hinged to the top of the back panel 3 by means of short straps. The lid 6 is shown in its open position in FIG. 2. The open top of the sack 1 may be closed by means of a drawstring 7 threaded through a binding along the top peripheral edge of the sack 1.

The sack 1 may define a single storage compartment or several compartments. For example, the rucksack shown in FIG. 1 has a lower compartment 8 to which access is obtained by an opening in the front panel 2 closable by means of a zip fastener (not shown). In well known manner, the sack 1 may be provided with pockets and carrying loops.

The rucksack is provided with side compression straps 9 which are threaded through buckles 10 fixed to the wall of the sack 1. The compression straps 9 may be tightened by pulling the straps through the buckles 10, to pull the front panel 2 and back panel 3 towards each other to aid in compressing the load within the sack 1.

The sack 1 is provided in well known manner, with a carrying harness 11 and a padded waistbelt 12 which in use rests on the hips of the user. A suitable adjustable harness and waistbelt arrangement which may be used is that described in PCT WO94/26143.

In accordance with the invention, the rucksack has a frame member for aiding in transferring load from the front of the rucksack to the waistbelt 12. The frame member comprises a flexible rod 20. The rod 20 may be made from glassfibre, plastics, metal, or the like. Suitably, the rod 20 is made from an acetal plastics, such as that sold under the trade mark "DELRIN". Suitably, the rod is circular in cross-section and has a diameter of from 5 to 12 mm depending upon the size of the rucksack and a length of from about 90 cm to 130 cm.

The rod 20 is bent to form a substantially u-shaped hoop which is attached to the exterior of the rucksack. The hoop 20 extends from the back of the rucksack around to the front. The free ends of the rod are attached to the hip belt of the rucksack as described in more detail below.

In the embodiment shown in FIG. 1 the hoop 20 is housed in a hollow fabric sleeve 21. The sleeve extends from the lower back corner 22 on each side of the rucksack, diagonally and upwardly across the side panels 4 and the front panel 2 of the rucksack. Suitably, the sleeve 21 is sewn to the fabric forming the panels 2, 4.

In the particular embodiment shown in FIG. 1, the sleeve 21 incorporates a flap 23 which extends over a zip fastener of the opening of lower compartment 8.

Where the sleeve 21 traverses each side panel 4 of the rucksack, it is provided with a gusset 24 to which is sewn a compression strap 25. The free end of the strap 25 is fastened to a buckle 26 attached, at a higher level, to the back edge of each side panel 4 such that the strap 25 extends diagonally upwardly towards the back of the rucksack.

A second gusset 27 is formed in the sleeve 21 at a position approximately mid-way of the front panel 2 and also approximately midway of the rod 20. A compression strap 28 is sewn to this gusset 27 and extend substantially vertically upwardly and under the lid 6 of the rucksack. The free end of the strap 28 is threaded through a buckle 29 attached to the top of the back panel 3 of the sack 1 (see FIG. 2) adjacent the back of the rucksack.

Figure 2:
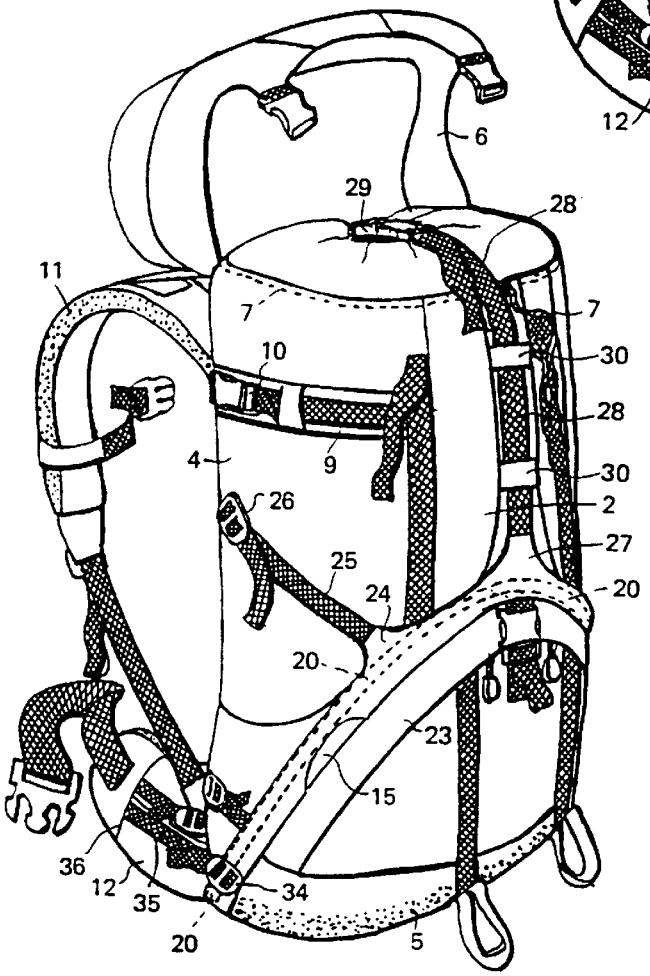
FIG. 2 is a view similar to FIG. 1, but with the lid of the rucksack in an open position.
Figure 3:
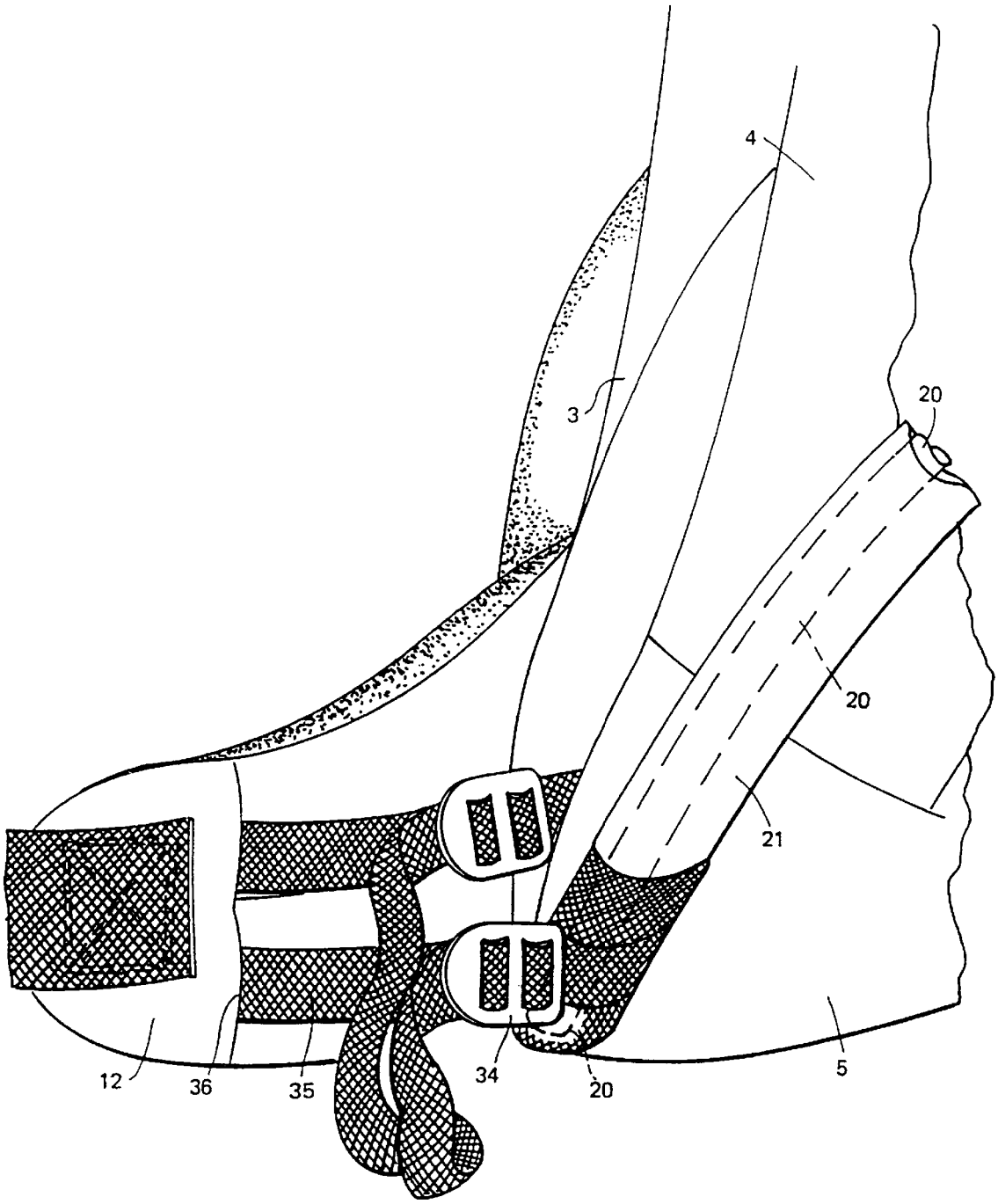
FIG. 3 shows a detail of the rucksack of FIG. 1.
Figure 5:
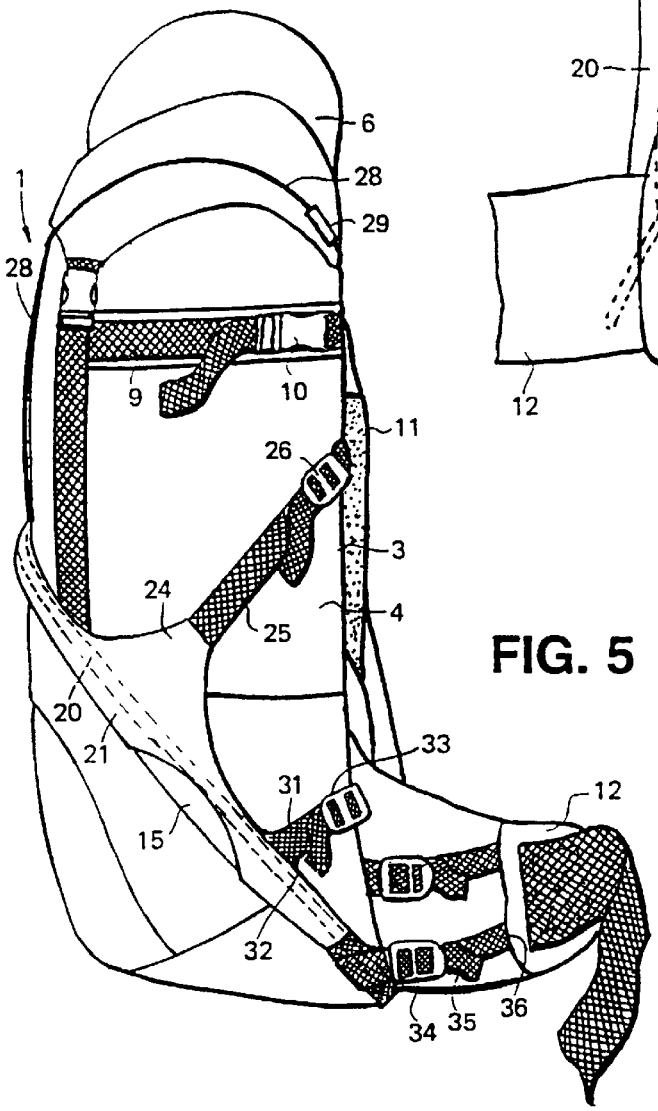
FIG. 5 is a side view of the rucksack of FIG. 1.
Figure 6:
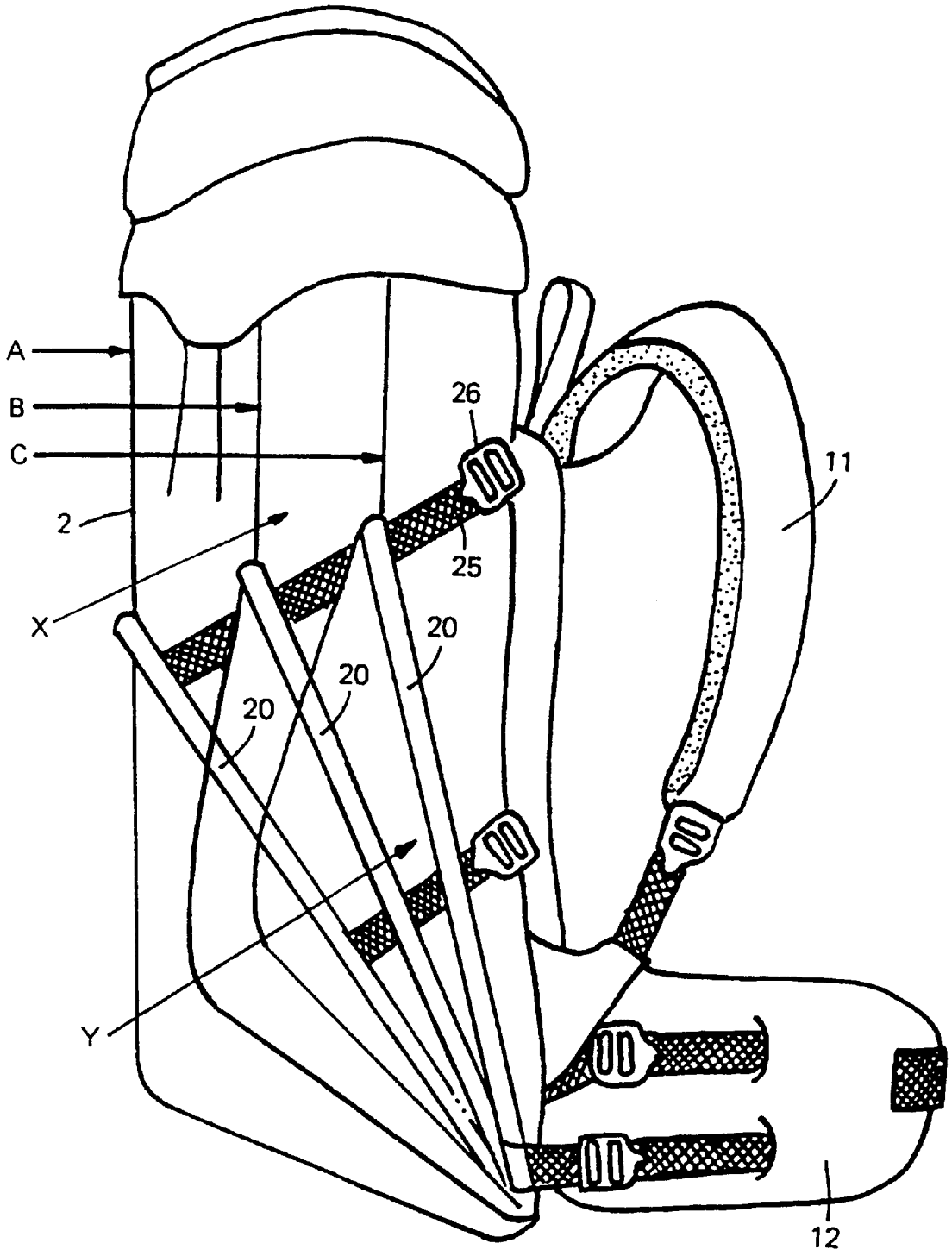
FIG. 6 shows a side view of the rucksack with a hoop of the invention in different positions.
Figure 7:
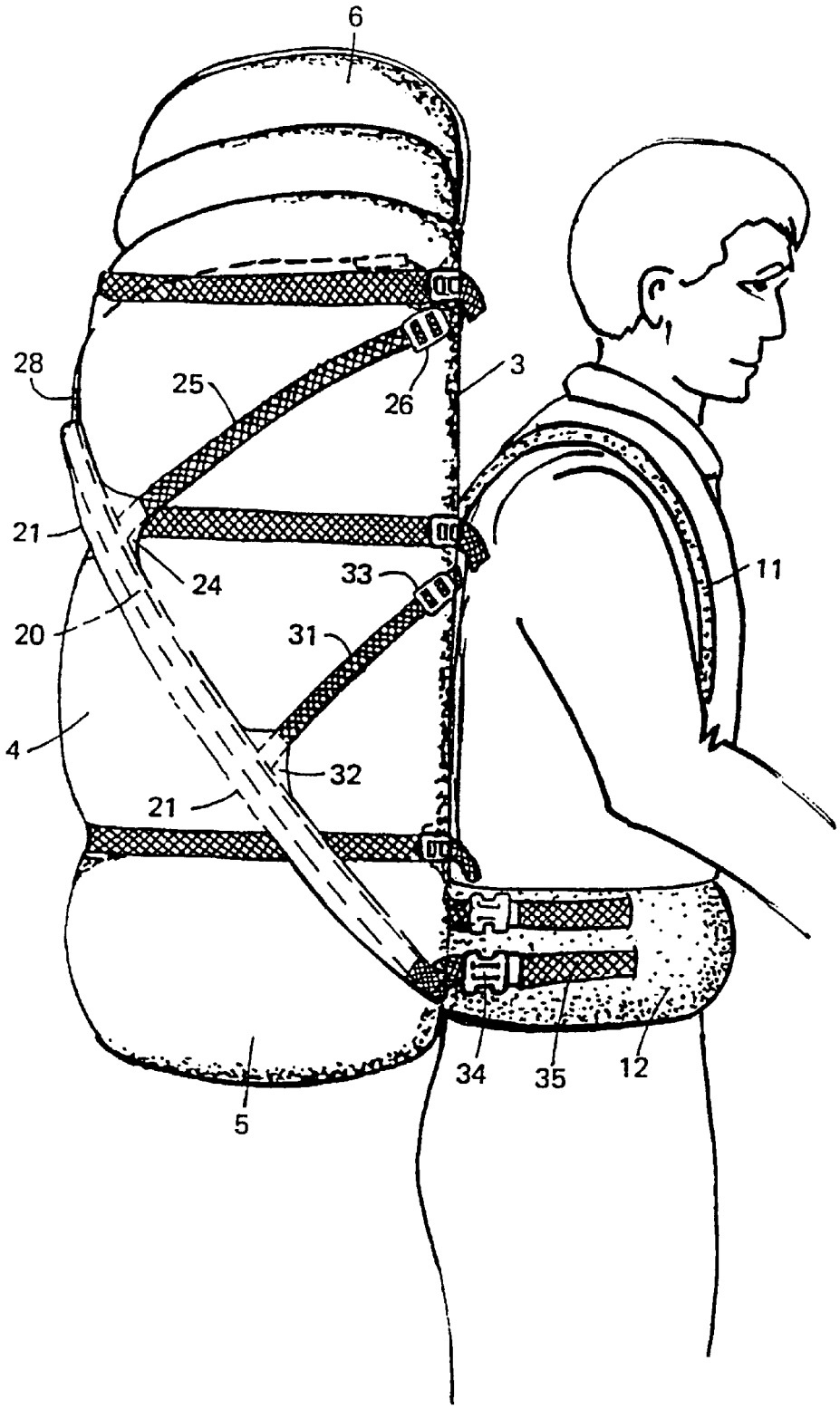
FIG. 7 shows a rucksack of the invention carried on the back of a user.

As shown in FIGS. 1 and 2 the vertical compression strap 28 is optionally threaded through guide loops 30 stitched to the front panel 2. As shown in FIGS. 5, 6 and 7, an optional second side compression strap 31 may be provided on each side panel extending from a gusset 32 on the sleeve 21 to a buckle 33 sewn to the back edge of the side panel 4. The method of attaching the free ends of the rod 20 to the waist belt 12 of the rucksack is illustrated in FIG. 3. As shown, a buckle 34 is attached to each end of the sleeve 21. One end of a compression strap 35 is threaded through the buckle 34. The other end of the strap 35 is stitched by a line of stitching 36 to the waist belt. In this way the position of the end of the rod 20 relative to the waist belt 12 can be adjusted by tightening the strap 35. The second strap and buckle shown above the strap 35 and the buckle 34 in FIG. 3 are for tightening the pack and are optional.

FIG. 6 illustrates various positions assumed by the hoop 20 as the compression straps 25, 28 and 31 are tightened. It will be noted that as the straps are tightened the hoop 20 is drawn towards the back of the rucksack, that is it effectively pivots about a horizontal axis extending between the free ends of the rod 20 where they meet the waist belt. The position of the hoop 20 when the sack 1 is full is shown at A. B shows the position when the sack 1 is half full, and C the position when the sack 1 is almost empty. The arrows X and Y show the direction of movement of the hoop 20.

Thus, the hoop 20 is compressed relative to the rucksack so as to press against a load contained within the rucksack and so controls movement of that load.

The hoop 20 forms a semi-rigid bow which reduces swaying of the rucksack in use, and presses the load in the rucksack towards the lumbar area of the user. Unlike conventional rucksacks, the load within the rucksack is prevented from sagging to the bottom of the rucksack, and instead the hoop 20 encourages the load in towards the back of the carrier. The hoop 20 supports both the front and side of the pack.

Preferably, the rod 20 forming the hoop is tensioned and held in tension by the fabric sleeves. The tension in the rod 20 assists in maintaining control of the load and assists in preventing swaying of the rucksack.

Thus, the rucksack of the invention offers a number of advantages over prior art rucksacks. The hoop 20 acts very effectively in transferring load from the front of the rucksack to the waistbelt 12 and to the internal frame at the back of the rucksack. The hoop 20 also allows small loads in the sack 1 to be tightly controlled. When the sack 1 is partially empty the hoop 20 can be tightened by the compression straps 25, 28 to pull the contents of the sack 1 evenly in towards the back panel 3 to create a tight, flat load. Also, the hoop 20 acts very effectively in controlling swaying of the rucksack, horizontally from side to side, as it is carried. It also controls load movement within the sack 1 in the vertical plane by reducing sagging and bouncing of the front of the sack 1 during use.

Figure 4:
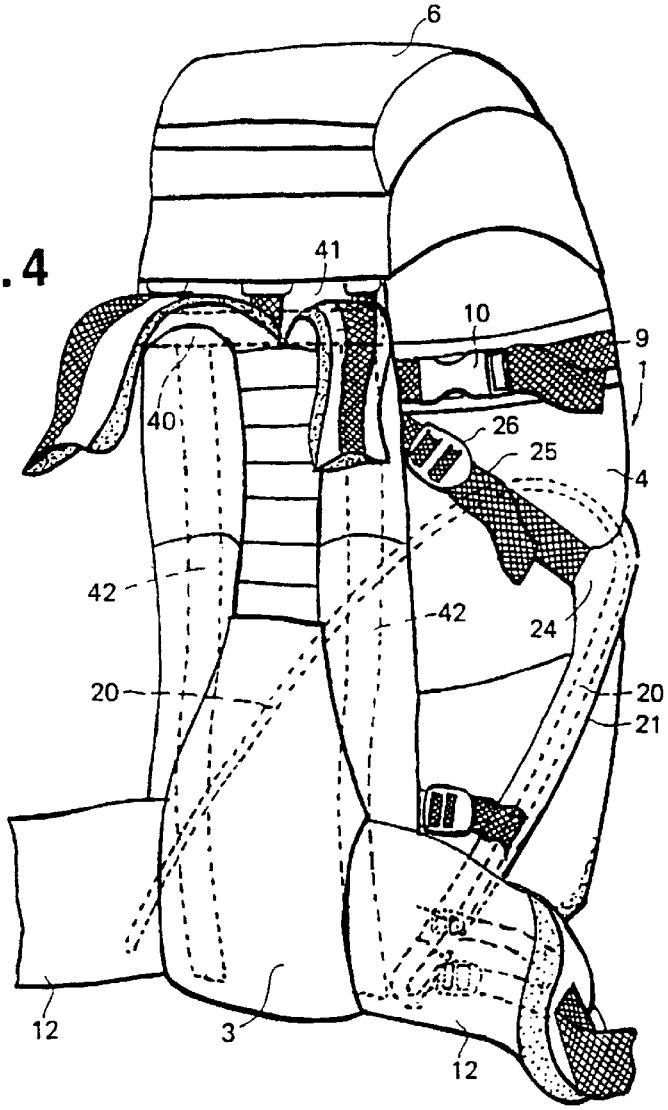
FIG. 4 is a view of the back of the rucksack of FIG. 1.

As shown in FIG. 4, a transverse rod or bar 40 may optionally be provided at the upper back near the top of the back panel 3 of the rucksack to maintain the rucksack flat against the back of the user. The bar 40 may be retained in a sleeve 41. Also as shown in FIG. 4, the rucksack may be provided with a conventional internal frame comprising metal staves 42. The transverse bar 40 acts also as a force-spreading aid to upper radial tensioning straps of the rucksack. The bar 40 also assists in transferring load from the upper straps directly to the staves 42. It also prevents the sack 1 from barreling away from the body at the sides.

As shown in FIGS. 1, 2 and 5, arc-shaped slots 15 may be provided, between the sleeve 21 and the underlying surface of the rucksack, at each side panel (4). These slots 25 facilitate the carrying of skis on the rucksack. One of a pair of skis (not shown) may be passed through each slot 15 for a secure attachment. The hoop 20 stabilizes and tightly secures the skis within the tensioned system.

FIG. 7 shows the rucksack, fully loaded, being carried by a user.

Modifications may be made to the rucksack of the invention without departing from the scope of the claims. For example, in the embodiments described the hoop 20 effectively acts as an external frame member. However, it would be possible to locate the hoop 20 on the inner surface of the panels 2, 4. As described, the hoop 20 is positioned within a continuous sleeve 21. However, alternatively the hoop 20 could be retained by means of short sleeves, loops or belts affixed to the walls of the sack 1.

I claim:

1. A rucksack comprising a sack having a front wall, a back wall and two side walls, and a carrying harness including a waistbelt wherein the rucksack includes a frame comprising a semi-rigid hoop which extends around the side walls and the front of the sack, and which is retained in a sleeve or sleeves or loops formed in or attached to the side walls and front wall of the sack and the hoop extends from the lower back corner on each side of the sack, at or adjacent the waistbelt, across the front of the rucksack, and wherein the ends of the hoop are connected, one at each side of the rucksack, to the waistbelt by adjustable strap means, whereby in use of the rucksack load is transferred from the front of the rucksack to the waistbelt.

2. A rucksack as claimed in claim 1, wherein the hoop is adjustable to press a load carried within the sack towards a lumbar area of a user carrying the rucksack.

3. A rucksack as claimed in claim 2, wherein compression straps are attached to the hoop at intervals and are connected between the hoop and the sack whereby the position of the hoop may be adjusted relative to the back wall of the rucksack.

4. A rucksack as claimed in claim 1, wherein the hoop is substantially of inverted u-shape.

5. A rucksack as claimed in claim 4, wherein the hoop comprises a rod which is bent to a substantial u-shape and is held under tension by the sleeve or sleeves.

6. A rucksack as claimed in claim 3, wherein the hoop is pivotable about an axis extending between ends of the hoop located at or adjacent the waistbelt such that when compression straps are tightened the hoop is drawn towards the back wall of the rucksack.

7. A rucksack as claimed in claim 1, wherein the hoop comprises a flexible rod housed in a fabric sleeve or sleeves or loops formed in or attached to the walls of the sack and which extends from the lower back corner on each side of the sack, diagonally and upwardly across the side panels and across the front panel of the sack, and wherein compression straps are attached at intervals between said sleeve or sleeves or loops and locations at or adjacent the back whereby the sleeve or sleeves or loops and the rod contained therein may be pulled towards the back wall of the sack.

8. A rucksack as claimed in claim 1, wherein a member extends transversely across the back wall of the sack to maintain the sack, when in use, flat against the back of the user.

9. A rucksack as claimed in claim 1, wherein the semi-rigid hoop comprises a flexible rod which is of substantially u-shape and is held under tension in a sleeve or short sleeves formed in or attached to the side walls and front wall of the sack, and the hoop extends from the lower back corner on each side of the sack, across the side walls and front wall of the sack, and wherein at each lower back corner of the sack the free ends of the hoop are connected, one at each side of the sack, to the waistbelt by means of a buckle attached to each end of the sleeve containing the ends of the hoop, and one end of a strap is threaded through the buckle and the other end is fixed to the waistbelt.

10. A rucksack as claimed in claim 9, wherein compression straps are attached at intervals between said sleeve or sleeves and locations at or adjacent the back of the sack whereby the sleeve or sleeves and rod contained therein may be pulled towards the back of the rucksack.

11. A rucksack as claimed in claim 1, wherein the hoop is located either externally or internally of the walls of the sack.

* * * * *